US010695651B2

(12) United States Patent
Paglierani et al.

(10) Patent No.: US 10,695,651 B2
(45) Date of Patent: Jun. 30, 2020

(54) PROTECTION DEVICE FOR CARRYING OUT SPORTS ACTIVITIES USABLE IN A DATA ANALYSIS AND MONITORING SYSTEM, AND RELATIVE SYSTEM AND METHOD FOR PROCESSING AND CALCULATING THE SENT DATA

(71) Applicant: GHST WORLD INC., New York, NY (US)

(72) Inventors: Pietro Paglierani, Chiasso (CH); Alberto Biancalana, Chiasso (CH); Giustiniano La Vecchia, Chiasso (CH); Marco Banchini, Chiasso (CH)

(73) Assignee: GHST WORLD INC., New York, NY (US)

( * ) Notice: Subject to any disclaimer, the term of this patent is extended or adjusted under 35 U.S.C. 154(b) by 54 days.

(21) Appl. No.: 15/775,523

(22) PCT Filed: Jul. 13, 2016

(86) PCT No.: PCT/IB2016/054182
§ 371 (c)(1),
(2) Date: May 11, 2018

(87) PCT Pub. No.: WO2017/081555
PCT Pub. Date: May 18, 2017

(65) Prior Publication Data

US 2018/0318694 A1 Nov. 8, 2018

(30) Foreign Application Priority Data

Nov. 13, 2015 (IT) ..... UB2015A5574

(51) Int. Cl.
*A63B 71/12* (2006.01)
*A63B 24/00* (2006.01)

(52) U.S. Cl.
CPC ..... *A63B 71/1225* (2013.01); *A63B 24/0021* (2013.01); *A63B 71/12* (2013.01);
(Continued)

(58) Field of Classification Search
CPC ..... A63B 71/1225; A63B 24/0021; A63B 2024/0025; A63B 2024/0056;
(Continued)

(56) References Cited

U.S. PATENT DOCUMENTS

2007/0032951 A1* 2/2007 Tanenhaus ..... G01C 21/16 702/151
2010/0030482 A1 2/2010 Li
(Continued)

FOREIGN PATENT DOCUMENTS

EP 1992389 A1 11/2008
KR 1020100032273 A 3/2010
(Continued)

OTHER PUBLICATIONS

Pham Duy Duong and Young Soo Suh: "Foot Pose Estimation Using an Inertial Sensor Unit and Two Distance Sensors", Jul. 3, 2015 (Jul. 3, 2015), XP002762515, Retrieved from the Internet [retrieved on Oct. 4, 2016].

*Primary Examiner* — Corbett B Coburn
(74) *Attorney, Agent, or Firm* — David A. Guerra

(57) ABSTRACT

Protection device (1) for sports activities, analysis and monitoring system (14) of data sent by a protection device and method for processing and calculating the data sent by a protection device where the protection device (1) comprises a localization unit (2) adapted to detect the positioning data (P) of the user, a detection unit (3) adapted to detect the movement data (A, M, W) of the user; at least a communication unit (6), operatively connected to the localization unit (2) and to the detection unit (3) and adapted to send/receive
(Continued)

said positioning data (P) and movement data (A, M, W) to/from at least an external module (7).

20 Claims, 4 Drawing Sheets

(52) U.S. Cl.
CPC ..... *A63B 2024/0025* (2013.01); *A63B 2024/0056* (2013.01); *A63B 2071/125* (2013.01); *A63B 2071/1258* (2013.01); *A63B 2220/12* (2013.01); *A63B 2220/30* (2013.01); *A63B 2220/40* (2013.01); *A63B 2220/836* (2013.01); *A63B 2225/20* (2013.01); *A63B 2225/50* (2013.01)

(58) Field of Classification Search
CPC ..... A63B 2071/125; A63B 2071/1258; A63B 2220/12; A63B 2220/30; A63B 2220/40; A63B 2220/836; A63B 2225/20; A63B 2225/50
See application file for complete search history.

(56) References Cited

U.S. PATENT DOCUMENTS

| | | | | |
|---|---|---|---|---|
| 2014/0173812 | A1* | 6/2014 | Krueger | A42B 3/122 2/455 |
| 2016/0103220 | A1* | 4/2016 | Ramsaran | G09B 19/0038 702/182 |

FOREIGN PATENT DOCUMENTS

| | | | |
|---|---|---|---|
| WO | 2009067837 | A1 | 6/2009 |
| WO | 2011096793 | A1 | 8/2011 |
| WO | 2015092533 | A1 | 6/2015 |

* cited by examiner

Fig. 1
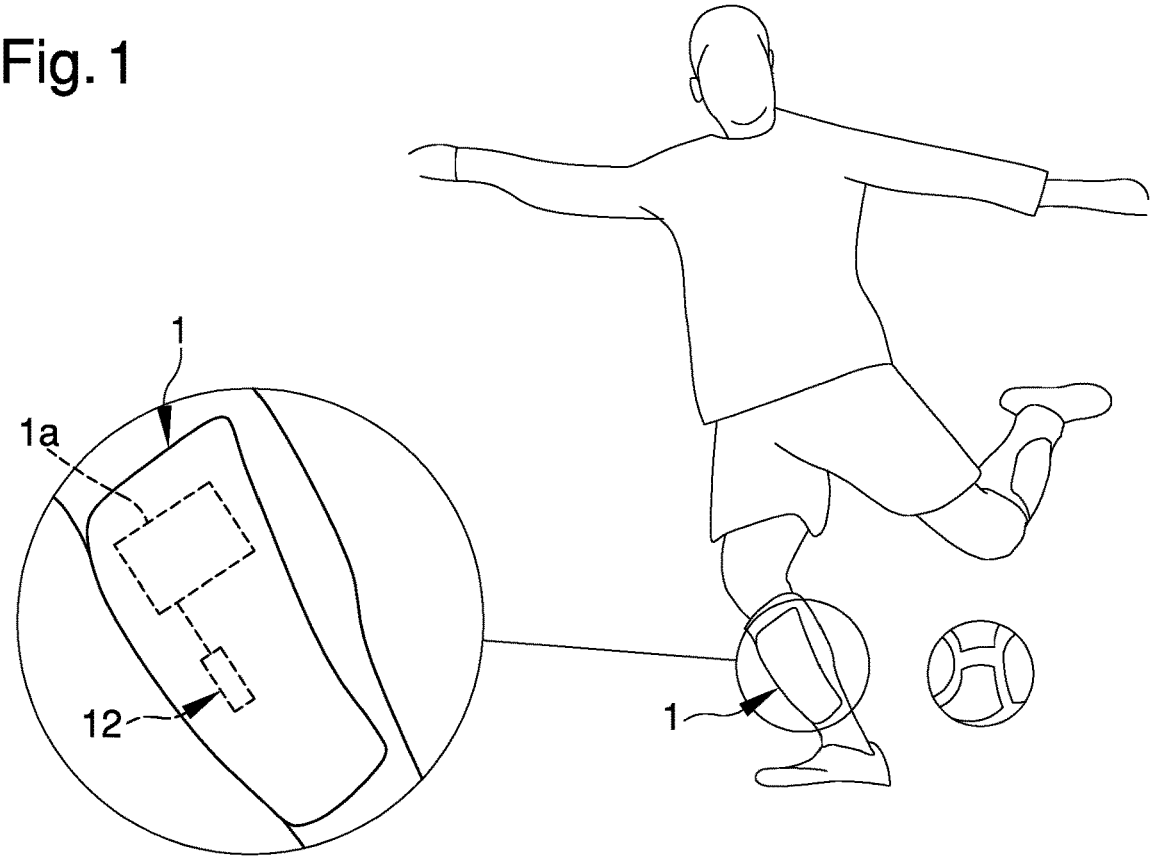
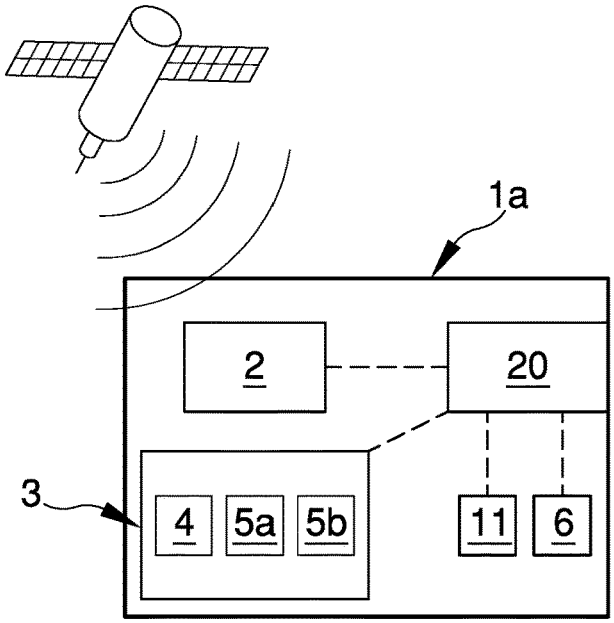
Fig. 2
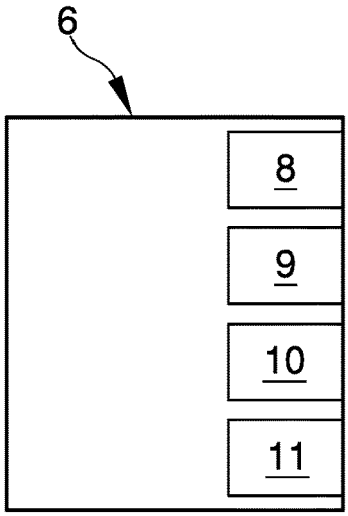
Fig. 3

PROTECTION DEVICE FOR CARRYING OUT SPORTS ACTIVITIES USABLE IN A DATA ANALYSIS AND MONITORING SYSTEM, AND RELATIVE SYSTEM AND METHOD FOR PROCESSING AND CALCULATING THE SENT DATA

TECHNICAL FIELD

The present invention relates to a protection device for carrying out sports activities insertable in a sent data analysis and monitoring system and relative system and method for processing and calculating the sent data.

BACKGROUND ART

Protection devices, i.e., protective equipment, are known, usable during the performance of sports activities for the purpose of protecting one or more parts of the body from potentially dangerous knocks and contacts.

Among this type of device are shin guards, mainly used in soccer or similar sports (5-a-side soccer, 7-a-side soccer and the like).

Shin guards are rigid or semi-rigid supports, shaped so as to cover the front portion of the leg and the function of which is to cushion the effect of any direct blows on the user's shins.

Other protection devices wearable during the performance of sports activities are elbow guards, knee guards and other similar equipment used to protect one or more parts of the body against contacts potentially dangerous for the safety of the athlete.

The need is known to monitor the physical conditions of the athletes, both as regards individual performances, and as regards team performance.

Furthermore, training methods and monitoring techniques have been developed, both as regards training and the match, which require the processing of data and information to be acquired during the carrying out of the activities.

For example, modern "match analysis" techniques involve a study phase of the data on individual and collective performance such as, e.g., the position of the players on the field, the distances between them and their changes in real time.

This information is acquired during activities by means of various different acquisition systems (from images, videos, metabolic parameters, blood tests, etc.).

In this context, there is an increasingly greater need to obtain data sampled directly on the individual athletes and to be analysed both in real time and in a subsequent post-processing.

The known techniques in fact provide results often based on data obtained indirectly from images, videos or other parameters, bringing with them inevitable errors of accuracy which are propagated in the processing operations subsequent to sampling, until the goodness of the end results is affected.

The processing of the detected data in fact is an aspect of far from secondary importance precisely because it affects the precision of the end results.

The known processing methods are based on techniques and algorithms based on mathematical models describing the athlete's movements.

Among the known techniques, mention is made of the "Zero Velocity Update Techniques" (ZUPT), the models of which describe the gesture of the walk/run identifying a number of points of interest to be associated with particular conditions (zero velocity).

The drawback of these techniques stems from the fact that they are not particularly suitable for use in sports activities such as soccer and the like.

In fact, the gestures of the athletes who practise these sports activities are unexpected and sudden, unlike a walk or linear run.

By applying the ZUPT techniques to soccer activities or the like, the statistical errors would not be negligible and their propagation would considerably affect the end result.

DESCRIPTION OF THE INVENTION

The main aim of the present invention is to provide a protection device for carrying out sports activities insertable in a sent data analysis and monitoring system and relative system and method for processing and calculating the sent data which allow both the detection and processing of data concerning the individual and collective performances of the athletes and the processing of information of improved accuracy compared to known processing techniques.

One object of the present invention is to provide a protection device for carrying out sports activities insertable in a sent data analysis and monitoring system and relative system and method for processing and calculating the sent data which allow detecting individual and collective data directly on the athletes who are carrying out sports activities.

A further object of the present invention is to provide a protection device for carrying out sports activities insertable in a sent data analysis and monitoring system and relative system and method for processing and calculating the sent data which allow the detection of data to be processed in real time.

Another object of the present invention is to provide a protection device for carrying out sports activities insertable in a sent data analysis and monitoring system and relative system and method for processing and calculating the sent data which allows to overcome the mentioned drawbacks of the prior art within the ambit of a simple, rational, easy, effective to use and affordable solution.

The objects set out above are achieved by the present protection device for carrying out sports activities insertable in a sent data analysis and monitoring system and relative system and method for processing and calculating the sent data having the characteristics of claim 1, of claim 15 and of claim 19.

BRIEF DESCRIPTION OF THE DRAWINGS

Other characteristics and advantages of the present invention will become better evident from the description of a preferred, but not exclusive, embodiment of a protection device for carrying out sports activities insertable in a sent data analysis and monitoring system and relative system and method for processing and calculating the sent data, illustrated by way of an indicative, but non-limiting, example in the accompanying drawings, wherein:

FIG. 1 is a schematic view of the device according to the invention;

FIGS. 2 and 3 are schematic views of details of the system according to the invention;

EMBODIMENTS OF THE INVENTION

Figure 4:
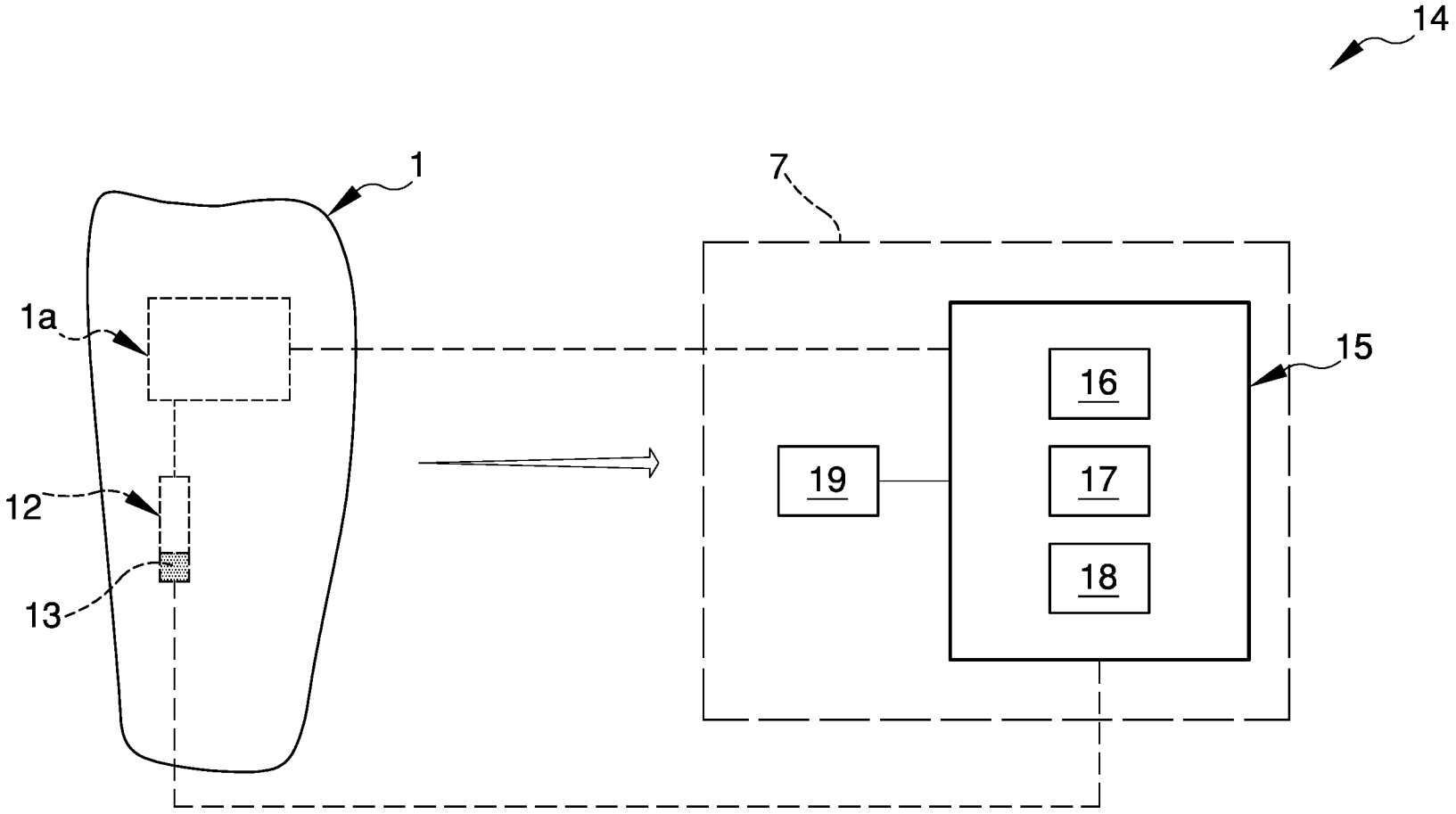
FIG. 4 is a schematic view of the system according to the invention.
Figure 5:
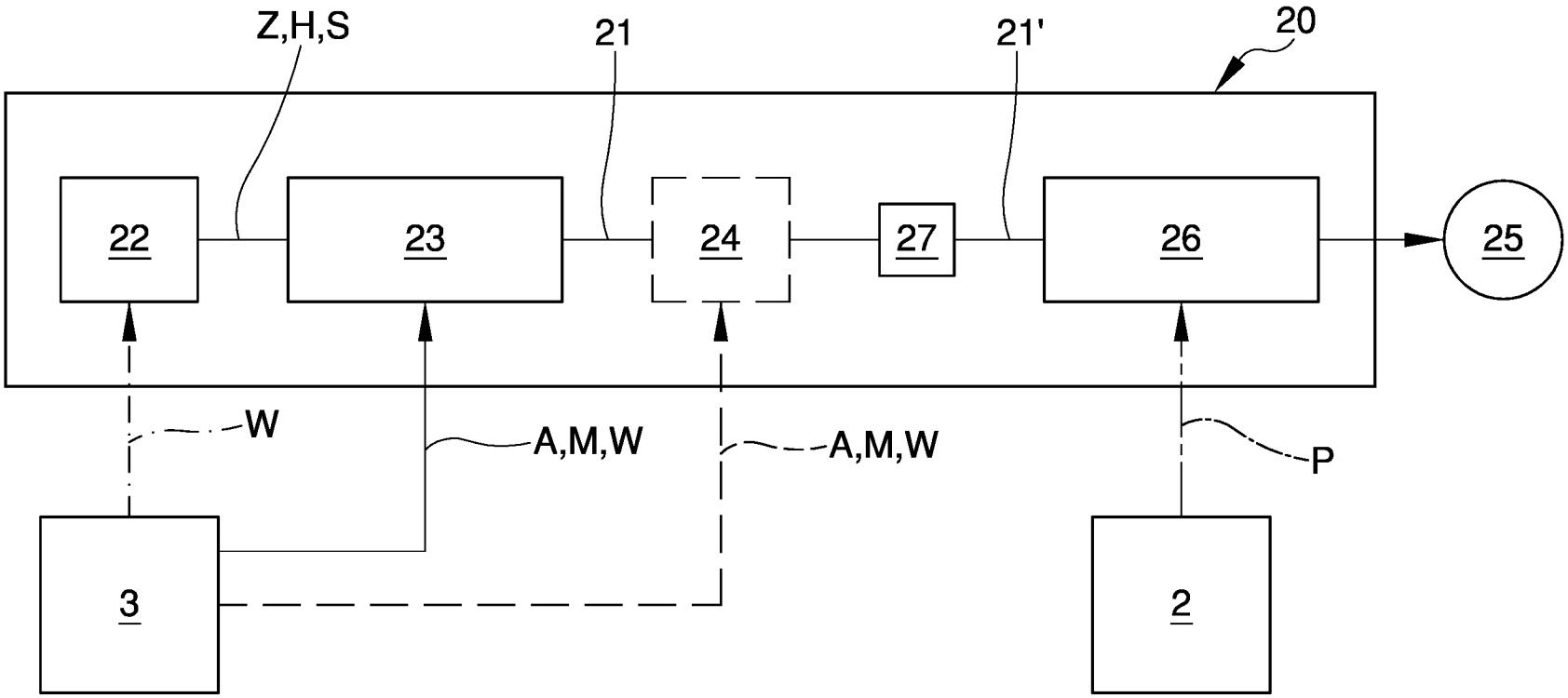
FIG. 5 is a schematic view of a detail of the device according to the invention.
Figure 6:
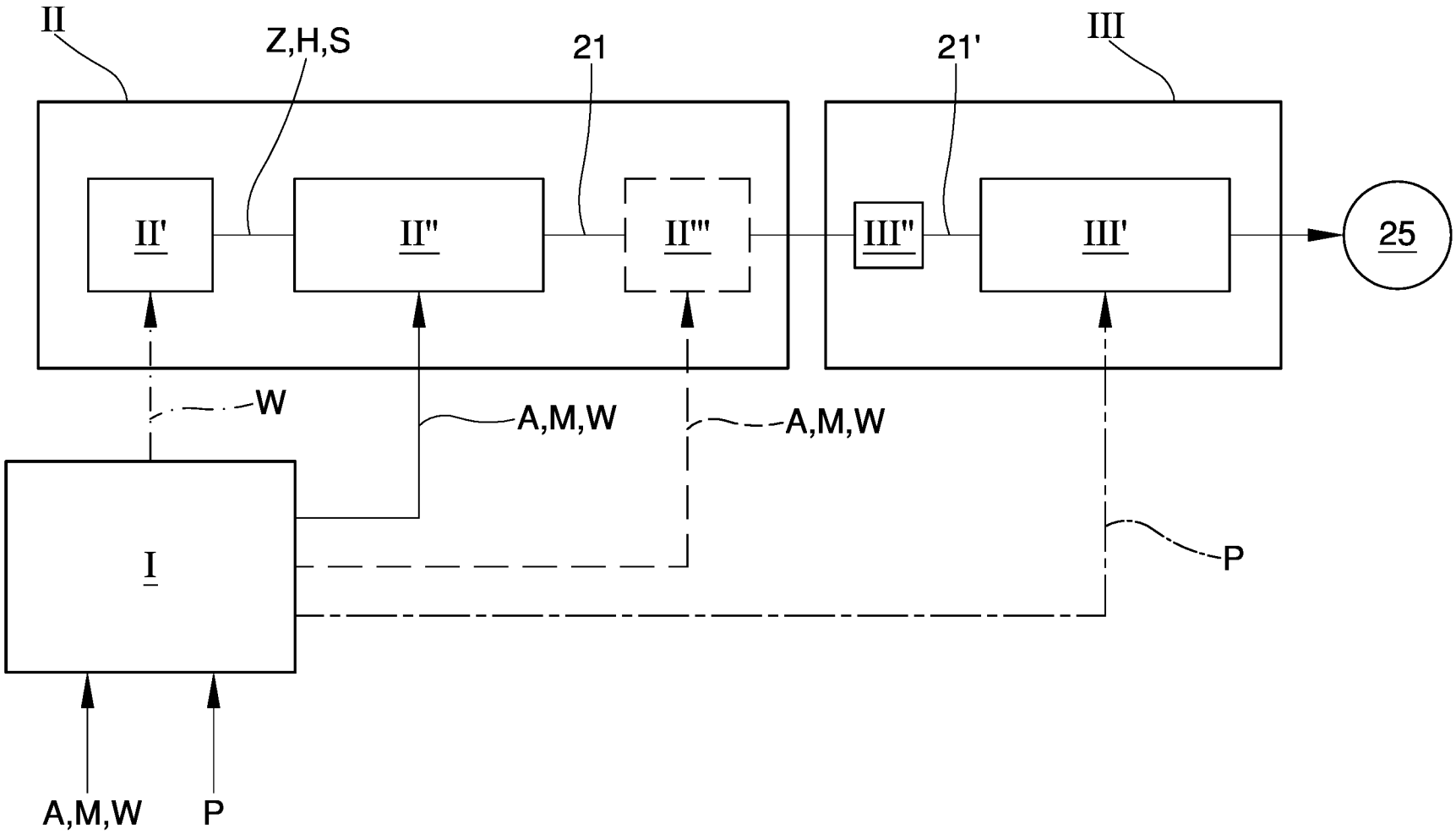
FIG. 6 is a schematic view illustrating a method for processing and calculating data sent by a device according to the invention.

With particular reference to such figures, reference number 1 globally indicates a protection device for carrying out sports activities by an athlete user.

The device 1, as previously described, is adapted to detect, process and communicate a data package comprising at least positioning data P and movement data A, M, W.

In the present treatise, the letters P, A, M, W each represent triads of values referred to triads of orthogonal axes.

In particular, the present embodiment describes a device 1 of the type of a shin guard usable by players of soccer and similar sports such as five-a-side and seven-a-side soccer, to protect their legs from blows and knocks.

Different embodiments cannot be ruled out wherein, e.g., the device 1 is of the type of an elbow guard or a knee guard or another type of protection sports equipment.

According to the invention, the device 1 comprises at least a localization unit 2 adapted to detect the positioning data P of the user.

In particular, the localization unit 2 is of the type of a GNSS receiver adapted to receive position information deriving from a satellite constellation.

This way the device 1 permits detecting the position of the athlete on the playing field at different time intervals.

Such data permit showing the athlete on the field in real time and make possible the extraction of all information relating to movement, speed, metabolic powers, travel time and, in general, all information tied to a shift over distance, in particular the advantages expressed in the unit of time.

Always according to the invention, the device 1 comprises a detection unit 3 adapted to detect the movement data A, M, W of the user.

In particular, the detection unit 3 comprises a detection sensor of the acceleration 4 of the user.

In the present embodiment, the detection sensor of the acceleration 4 is of the type of an accelerometer.

The accelerometer 4 is able to record the forces of physical type which the athlete has to undergo such as contacts, instantaneous movements, jumps, falls, power with which the ball is hit, impact force suffered or impressed on another athlete, and other similar information.

The data recorded and sent by the accelerometer 4 are indicated hereunder by the letter A and make reference to the acceleration detected by the instrument.

Furthermore, the detection unit 3 also comprises at least a detection sensor of the displacement 5 for detecting the displacement of the user.

In particular, the detection sensor of the displacement 5 comprises a gyro sensor 5*a*.

The latter provides data on the displacement of the athlete and thus permits obtaining both greater information on movement speed and a redundancy of data adapted to improving the accuracy of the measurements.

The data recorded and sent by the gyroscope 4 are indicated below by the letter W and relate, in particular, to the angles designed by the leg in space and detected by the instrument.

The detection sensor of the displacement 5, furthermore, comprises a magnetometer 5*b*, adapted to provide data on the directions in which the displacements occur.

Such data are indicated below by the letter M.

In the present embodiment, the device 1 comprises both an accelerometer 4, and a gyro sensor 5*a*, and a magnetometer 5*b*, but different embodiments cannot be ruled out wherein, e.g., there is only one of the accelerometer 4, the gyro sensor 5*a* and the magnetometer 5*b*.

Just as embodiments cannot be ruled out wherein there are just two of the already-mentioned accelerometer 4, gyro sensor 5*a* and magnetometer 5*b*.

Furthermore, a solution cannot be ruled out which envisages the use of a different number of accelerometers 4, gyro sensors 5*a* and magnetometers 5*b*.

The device 1, therefore, permits detecting movement data A, M, W, such as accelerations and displacements, which can be integrated and combined with the positioning data P deriving from the localization unit 2.

Furthermore, such integration permits providing a sufficient quantity of data to implement calculation systems that can provide very precise output data.

Advantageously, the device 1 comprises a data processing unit 20 adapted to process the movement data A, M, W and the positioning data P for obtaining information on the sports activity of an athlete, in particular information aimed at assessing individual and team performance.

The processing unit 20 comprises means for the acquisition of movement data A, M, W.

The acquisition means of movement data A, M, W are associated with the detection unit 3 and adapted to receive from it the movement data A, M, W detected by the device 1.

The processing unit 20 comprises first processing means 22, 23 adapted to use at least part of the movement data A, M, W in combination with a first mathematical model descriptive of the movement to obtain first output data 21.

In the present embodiment, the modelled movement is the walk/run of an athlete and the mathematical model is based on the recognition of the static phase and of the oscillation phase of a single leg.

In particular, the mathematical model used is based on the recognition of particular points recognizable during the static phase of the walk/run starting from the analysis of the detected movement data A, M, W.

In this respect, the first processing means 22, 23 comprise a first preliminary unit 22 adapted to process at least part of the movement data A, M, W to obtain first input data Z, H, S adapted to implement the first mathematical model.

The first preliminary unit 22 processes the data detected by the gyroscopes relating to the opening angle which the leg traces on the sagittal plane, in the illustrations indicated by W.

The data processing of the first preliminary unit 22 permits detecting and defining at least three points of the walk referred to:

- the moment the user is stopped (zero velocity stationary point), conditions defined by the letter Z;
- the moment the heel touches the ground (heel-strike point), conditions defined by the letter H; and
- the moment the foot is resting on the ground and the leg is perpendicular to the support plane (mid-stance point), conditions defined by the letter S.

The information deriving from the preliminary unit 22 is used to implement the first mathematical model which, in the present embodiment, is an algorithm of the type of a Kalman filter.

The first processing means 22, 23, in fact, comprise a first calculation unit 23 associated both with the first preliminary unit 22 to receive the first input data Z, H, S, and directly with the acquisition means of the movement data A, M, W.

The first calculation unit 23 is adapted to implement the first model to obtain the first output data 21.

The first output data 21 are synthesis data adapted to provide first indications on the sports activity of the athlete or adapted to be reused for subsequent processing operations.

In particular, the first output data 21 comprise at least velocity synthesis data and corrective acceleration parameters.

The velocity synthesis data are preferably average velocities obtained from the detected accelerations, while the corrective acceleration parameters are "bias" values to be used to correct the acceleration detection error.

Conveniently, the processing unit 20 comprises an intermediate unit 24 associated with the connection unit 15 and with the first processing means 22, 23 adapted to shift the first output data 21 from a local reference system, i.e., that inside the device 1, to a global reference system.

This way, the first output data 21 can be combined with the data referred to different reference systems such as, e.g., the positioning data P deriving from the GNSS receiver.

Advantageously, the processing unit 20 comprises second processing means 26, 27 adapted to use the first output data 21 and the positioning data P in combination with a second mathematical model to obtain second output data 25 adapted to provide information on the athlete's sports activity.

The second output data are also synthesis data interpretable or usable to obtain indications on the sports performance of the athlete using the device 1.

In particular, the second output data 25 comprise at least displacement synthesis data and corrective velocity parameters.

The displacement synthesis data are preferably average velocities obtained from the detected accelerations, while the corrective velocity parameters are "bias" values to be used to correct the statistic error of the previously-calculated velocity values.

The second model is also an algorithm of the type of a Kalman filter and this too is based on the motion equations.

In this respect, the algorithm used in the data processing unit 20 offsets noise and drift present in the input data.

The second processing means 26, 27 comprise a second calculation unit 26 associated with the first calculation unit 23 to receive the first output data 21 and with the localization unit 2 to receive the positioning data P.

In particular, the second calculation unit 26 is associated with the intermediate unit 24 to receive the first transformed output data 21.

The second calculation unit 26 is adapted to implement the second model to obtain the second output data 25.

Advantageously, the second processing means comprise a supplementary unit 27 adapted to process the first output data 21 to obtain the second input data 21' to be inserted in the second calculation unit 26 and compatible with the second model.

The second output data 25 are the displacements of the athlete and corrective average velocity parameters deriving from the first calculation unit 23.

This way, it is possible to maximize the precision of the data to be used, for example in the "match analysis" techniques.

Always according to the invention, the device 1 comprises at least a communication unit 6, operatively connected to the localization unit 2 and to the detection unit 3 and adapted to send/receive the positioning data P and movement data A, M, W and/or a processing of these same data to/from a generic external module.

In this preferred, but not exclusive embodiment, the data sent by the localization unit 2 to the external module 7 are a processing of the detected data P, W, A, M.

In particular, an external module is an assembly of fixed and mobile electronic media, software, hardware, peripheral networks and other electronic control units adapted to receive data from the device and allow these to be post-processed, processed, displayed, analysed and other data processing operations aimed at obtaining useful information on the conditions of the athlete or, in the case of several devices, of the athletes.

In the present embodiment, the external module has been indicated by reference number 7 and is described in detail on the following pages of this treatise.

In the present embodiment, the communication unit 6 is associated with the data processing unit 20 for the receipt of the second output data 25.

The communication unit 6 comprises at least one of a radio-wave transceiver element 9, 10 and a first connection gate 8 adapted to connect the device 1 to peripheral units such as external memories, USB pen drives, peripheral networks and other hardware units.

The connection gate 8 is of the type of a USB input port, but different solutions cannot be ruled out such as input ports for SSID boards, ports for Ethernet cables and other connection modules with external peripheral units.

The solution cannot be furthermore ruled out which provides for a combination of all the previously-described solutions, with a single connection gate 8 comprising several ports or several modules as described above.

Usefully, the radio-wave transceiver element comprises a Bluetooth transceiver 9.

Such characteristic permits sending the data processed by the processing unit 20 to one or more external peripheral units arranged in the proximity of the device 1 and without being connected by cables.

For example, in case of the sports activity being soccer, the external peripheral units could be auxiliary receivers positioned at the side of the field and adapted to receive the data from the device by means of a Bluetooth connection.

In the present embodiment, the radio-wave transceiver element 9, 10 also comprises a Wi-Fi transceiver 10.

This way, the data acquired by the device 1 can be processed and put online without using receivers positioned at the side of the field, with the advantage of being able to facilitate communication between the device itself and the external peripheral units.

Furthermore, the Wi-Fi transceiver comprises IEEE802.3 compatible Wi-Fi sensors.

Such characteristics permit obtaining a device 1 with reduced absorption and therefore with reduced energy consumption.

In the present embodiment, the communication unit 6 comprises, besides the connection gate 8, both a Bluetooth transceiver 9, and a Wi-Fi transceiver 10, so as to be able to allow a plurality of solutions for using the device 1.

In the present embodiment, the device 1 comprises a first memory unit 11 adapted to record the movement data A, M, W and positioning data P.

The first memory unit 11, in fact, is operatively connected to at least one of the localization unit 2, the detection unit 3 and, in particular, it is associated with the data processing unit 20 to receive processed data.

This way, the positioning data P and movement data sent by the localization unit 2 and by the detection unit 3 respectively can be both saved and recorded, and sent to the data processing unit 20 for their processing and subsequent sending to the communication unit 6 for their sending to external peripheral units.

Solutions cannot be ruled out whereby the device 1 is without memory unit 11.

In the embodiment shown in the illustrations, the units 2, 3, 6, 11 are installed on a single medium 1*a*.

Preferably, the medium 1*a* has a rectangular shape equal to 30 mm in width, 30 mm in length and 2.7 mm in height.

Different solutions cannot be ruled out wherein the medium 1*a* has different shape and dimensions, or wherein the device 1 comprises a different number of media, depending on the convenience.

In the present embodiment, with reference to a shin guard, the medium 1*a* is inserted inside the shin guard itself.

In particular, the medium 1*a* is placed between the outer portion of the shin guard, adapted to receive any blows, and the inner portion, adapted to come into contact with the athlete's leg.

This way, the functionality and the appearance of the shin guard are not negatively affected by the presence of the medium 1*a*.

The device 1, furthermore, comprises at least a rechargeable battery 12 adapted to supply the device itself with electricity.

Just like the medium 1*a*, the battery 12 is also obtained inside the shin guard.

As schematically shown in the illustrations, the battery 12 is operatively connected to the units 2, 3, 6, 11 in such a way as to allow their operation by means of the supply of electricity.

Usefully, the device 1 comprises induction recharging means 13 for recharging the battery 12, schematically shown in the illustrations, and adapted to allow a recharge by inductive effect of the battery itself.

Solutions cannot be ruled out wherein there are several batteries 12 connected independently to the various units 2, 3, 6, 11.

The device 1 described above can be inserted in a data analysis and monitoring system shown schematically in FIG. 4 and indicated by the reference number 14.

The system 14, advantageously, comprises an external module 7 operatively connected to the device 1 for the acquisition and processing of the data package. In the present embodiment, the external module 7 comprises a connection unit 15 adapted to connect the external module 7 to the device 1.

Usefully, the connection unit 15 comprises at least a connection port 16 for connecting external peripheral units.

The connection port 16 permits connecting the system 14 to peripheral units such as USB pen drives, SSID boards, network cables of the "Ethernet" type and other peripheral units useful for putting on line, processing and displaying the data package sent by the device 1 to the system 14.

The connection unit 15, furthermore, comprises a secondary transceiver element 17, this too useful for sending/receiving data to/from a peripheral network or the Internet.

Advantageously, the connection unit 15 also comprises an induction charger 18 operatively connected to the battery 12.

In particular, the induction charger 18 is adapted to interact with the induction recharging means 13 to accumulate electricity in the battery 12.

This characteristic permits recharging the device 1 without the use of cables, favouring the wearability and ergonomics of the device itself.

The cables of the battery chargers, in fact, require special inputs, achievable with electronic media and additional holes that would negatively affect both the wearability and ergonomics, and the life span of the device 1.

Furthermore, the connection unit 15 having such characteristics has the functions of a "concentrator", combining, therefore, the functions of battery charger with the functions of deferred transfer of data and the functions of "gateway" for the receivers or other media (mobile phones, tablets, etc.) for the publication in real time of the data acquired and sent to the web.

In the present embodiment, the external module 7 also comprises a second memory unit 19 adapted to receive and store the data package, or part thereof, coming from the device 1.

The external module 7, furthermore, comprises a post-processing unit, for simplicity not shown in the illustrations, adapted to synthesize the data processed by the processing unit 20 so as to allow a display and an interpretation of same both in terms of data referred to an individual user and in terms of data referred to several users, e.g., team data.

The operation of the present invention is the following.

The localization unit 2 and the detection unit 3 acquire the positioning data P and the movement data A, M, W concerning the athlete and send these to the processing unit 20.

The data processing unit 20 processes the data and sends the results both to the communication unit 6 for the real-time transfer of same to the external module 7, and to the memory unit 11 for saving.

The memory unit 11, besides saving the data, communicates with the communication unit 6 for the deferred transfer of same.

The communication unit 6 permits sending the data according to different modes depending on whether they are sent through the connection gate 8 or through the radio-wave transceiver elements 9, 10.

In fact, the connection gate 8 permits sending the data through removable physical media such as USB pen drives, SSID boards, or network cables, while the transceivers 9, 10 permit sending the data through electromagnetic waves.

The Bluetooth transceiver 9 sends to auxiliary receivers, not shown in the illustrations, arranged in the proximity of the play area and adapted to send the same data to the external module 7, or to another peripheral network.

The Wi-Fi transceiver 10, on the other hand, sends the acquired data directly to the external module 7 exploiting the Internet network.

The processed data are then sent to the external module 7 through the elements of the connection unit 15.

In particular, the connection port 16 can accommodate one of the physical media (USB, SSID, network cables and the like) coming from the connection gate 8 so as to implement the exchange of data with the device 1.

In exactly the same way, the exchange of data can be made by means of the secondary transceiver element 17.

The data received from the external module 7 are subsequently post processed by the post-processing unit so as to obtain a readable and interpretable display of the information related to them.

The induction charger 18, operatively connected to the battery 12, interacts with the induction recharging means 13 to recharge the device 1.

The second memory unit 19 present in the external module 7 allows saving and storing both the data coming from the device 1 and any post-processed data.

A method for processing and calculating the data sent from a protection device for carrying out sports activities is shown below.

The present method relates to values evaluated according to a generic axis of a Cartesian triad.

The method comprises a first phase I of acquisition of movement data A, M, W from the protection device 1, referred to a device reference system.

Such data refer to a movement of an athlete wearing the device 1.

In the present embodiment, the first phase I also comprises the acquisition of the positioning data P, but it cannot be ruled out that such data can be acquired in a phase independent of the phase I.

Subsequently, the method comprises a second phase II of use of at least part of the movement data A, M, W in combination with the first mathematical model, already shown above, descriptive of the movement of the athlete to obtain first output data 21.

In particular, the second phase II comprises a first processing II' of at least part of the movement data A, M, W to obtain the first input data Z, H, S adapted to implement the first mathematical model.

More in particular, the second phase II provides for the use of data referred to the angles W designed by the leg on the sagittal plane during the walk/run to define the conditions H, S and Z.

Subsequently, the second phase II comprises a first implementation step II" of the first model.

The first model, in the first calculation unit 23, receives at input the first input data Z, H, S and the movement data A, M, W and returns at output the first output data 21.

Usefully, the second phase II comprises an auxiliary combination II'" of the movement data A, M, W to obtain the shift parameters to be used to shift the first output data 21 from a local reference system to a global reference system.

In this step of the second phase II, the movement data A, M, W are combined so as to obtain a shift matrix useful for shifting the first output data 21 from the internal reference system of the device 1 to a global reference system, compatible with the positioning data P.

Finally, the method comprises a third phase III of use of the first output data 21 both in combination with the second mathematical model, previously illustrated, descriptive of the movement, and in combination with the positioning data P of the device 1 acquired by the localization unit 2 to obtain the second output data 25 adapted to provide information on the sports activity of the athlete.

The third phase III also comprises a second implementation step III' of the second model.

The second model receives at input both the first output data 21, shifted in the reference system of the positioning data P, and the positioning data P themselves and returns the second output data 25 at output.

Conveniently, the third phase III comprises a supplementary processing III" of the first output data 21 to obtain second input data 21' for the implementation of the second mathematical model.

In this case, the first output data 21 are processed to obtain average values to be subsequently used as input data for the implementation of the second calculation model.

It has in practice been ascertained that the described invention achieves the proposed objects and in particular the fact is underlined that the protection device provided for carrying out sports activity can be inserted in a system for the detection of data on the individual and collective performances of the athletes.

Furthermore, the device described above allows detecting individual and collective data directly on the athletes who are carrying out sports activity.

Thanks to the arrangement of the various localization and detection units on the device, the obtained data are referred directly to the individual athlete who is wearing the device.

This way, the need no longer exists to make use of indirect methods such as e.g. the empiric analysis of images or other parameters obtained using methods aimed at obtaining another type of information.

Furthermore, thanks to the integration of the accelerometer, of the gyro sensor and of the magnetometer, the obtained data can be processed by specific calculation systems in order to provide highly accurate information at output.

In particular, the method provided for data processing, then permits integrating the ZUPT techniques with the detection techniques from GNSS systems, obtaining a processing of the end data able to provide data which are more accurate and better able to respond to the real conditions.

The algorithm used, in fact, permits offsetting the noise and drift present in the input data, obtaining more accurate results.

Finally, thanks to the introduction of transceivers, in particular Wi-Fi transceivers, the device permits sending data in real time, favouring and improving the implementation of modern monitoring and "match analysis" techniques, e.g., relating to the positioning and distances between the players.

This way, in fact, a protection device could be obtained, i.e., a shin guard, which communicates directly with the web simply through a standard access point that acts as a gateway.

The invention claimed is:

1. A protection and detector system for physical activities, said system comprising:

at least one protection device configured to be wearable on a user, said protection device comprising:

at least one a localization unit configured to detect at least one positioning data of the user;

at least one a detection unit configured to detect at least one movement data of the user; and at least one a communication unit operatively connected to said localization unit and to said detection unit, said communication unit is configured to be in communication with at least one external module;

at least one data processing unit configured to acquire and process at least said movement data to obtain information on activity of the user utilizing a first mathematical model descriptive of movement to obtain first output data;

wherein said first mathematical model being at least partially based on a static phase and an oscillation phase of a part of the user wearing said protection device.

2. The system according to claim 1, wherein said localization unit, said detection unit and said communication unit are incorporated on a medium placed between an outer portion of said protection device and an inner portion, wherein said inner portion is configured to contact the user.

3. The system according to claim 1, wherein said localization unit includes a Global Navigation Satellite System (GNSS) receiver configured to receive position information deriving from a satellite constellation.

4. The system according to claim 1, wherein said protection device further comprises at least a rechargeable battery operably connected with at least one of said localization unit, said detection unit and said communication unit.

5. The system according to claim 4, wherein said protection device further comprises an induction recharging unit configured to recharge said battery and configured to allow a recharge by inductive effect of said battery.

6. The system according to claim 1, wherein said detection unit includes at least an acceleration detection sensor and at least a displacement detection sensor.

7. The system according to claim 6, wherein said displacement detection sensor comprises at least a gyro sensor and at least a magnetometer, wherein said movement data includes gyro sensor data, magnetometer data and acceleration data.

8. The system according to claim 7, wherein said protection device is worn on at least one leg, and wherein said first mathematical model utilizes at least three points of movement being a moment the user is stopped, a moment a heel of the user touches the ground, and a moment a foot of the user is resting on the ground and the leg is perpendicular to a support plane.

9. The system according to claim 8, wherein said first mathematical model is an algorithm utilizing a Kalman filter.

10. The system according to claim 9, wherein said data processing unit further comprises a first processing unit configured to acquire and process said movement data in combination with said first mathematical model; said first processing unit comprises a first preliminary unit configured to process at least said gyro sensor data of said movement data to obtain first input data configured to implement said first mathematical model.

11. The system according to claim 10, wherein said first processing unit further comprises a first calculation unit associated with said first preliminary unit, said first calculation unit is configured to receive said first input data and said movement data and configured to implement said first mathematical model to obtain said first output data.

12. The system according to claim 11, wherein said protection device further comprises a second processing unit configured to use said first output data and said positioning data in combination with a second mathematical model to obtain second output data.

13. The system according to claim 12, wherein said second processing unit comprises a second calculation unit associated with said first calculation unit, said second calculation unit is configured to receive said first output data and with said positioning data from said localization unit, said second calculation unit is configured to implement said second mathematical model to obtain said second output data.

14. The system according to claim 13, wherein said second processing unit further comprises a supplementary unit configured to process said first output data to obtain a second input data to be used in said second calculation unit and to be compatible with said second mathematical model.

15. The system according to claim 14, wherein said processing unit further comprises an intermediate unit associated with said detection unit and with said first processing means, said intermediate unit is configured to shift said first output data from a local reference system to a global reference system.

16. The system according to claim 14, wherein said external module comprises at least a connection unit configured to connect said external module with said communication unit of said protection device.

17. The system according to claim 16, wherein said connection unit comprises at least one of a connection port configured to connect external peripheral units, a secondary transceiver element, and an induction charger operatively connected to a battery of said protection device.

18. A method of using a protection and detector system configured to be wearable on a user, said method comprising the steps of:

a) placing at least one protection device on the user;

b) acquiring movement data from at least one detection unit of said at least one protection device;

c) processing, by at least one processing unit, at least a first part of said movement data with a first mathematical model descriptive of movement to obtain first output data, said first mathematical model being at least partially based on a static phase and an oscillation phase of a part of the user wearing said protection device; and d) processing said first output data in combination with a second mathematical model descriptive of said movement and in combination with positioning data from at least one localization unit of said at least one protection device to obtain second output data configured to provide information on physical activity of the user.

19. The method according to claim 18, where step c) further comprises the steps of:

conducting a first processing of at least a second part of said movement data to obtain said first input data configured to implement said first mathematical model;

conducting a first implementation step of said first mathematical model, said first mathematical model receiving at input said first input data and said movement data and returning at output said first output data; and obtaining shift parameters using an auxiliary combination of said movement data, and using said shift parameters to shift said first output data from a local reference system to a global reference system.

20. The method according to claim 18, where step d) further comprises the steps of:

conducting a second implementation step of said second mathematical model, said second mathematical model receiving at input said first output data and said positioning data, and returning said second output data at output; and conducting a supplementary processing of said first output data to obtain second input data for implementation of said second mathematical model.

* * * * *